US007530898B2

(12) United States Patent
Pinkart

(10) Patent No.: US 7,530,898 B2
(45) Date of Patent: May 12, 2009

(54) MATING GOLF GLOVE WITH CLUB GRIP

(76) Inventor: Patrick Pinkart, 325 Lilac Dr., Los Osos, CA (US) 93402

( * ) Notice: Subject to any disclaimer, the term of this patent is extended or adjusted under 35 U.S.C. 154(b) by 0 days.

(21) Appl. No.: 11/352,117

(22) Filed: Feb. 9, 2006

(65) Prior Publication Data

US 2007/0184911 A1 Aug. 9, 2007

(51) Int. Cl.
*A63B 53/14* (2006.01)

(52) U.S. Cl. ..... 473/205; 473/201; 473/300; 473/301; 473/302

(58) Field of Classification Search ..... 473/201, 473/205, 206, 212, 300–303, 203, 458, 464, 473/549, 551; 2/161.1, 161.2, 161.3
See application file for complete search history.

(56) References Cited

U.S. PATENT DOCUMENTS

| | | | | | |
|---|---|---|---|---|---|
| 3,028,283 | A * | 4/1962 | Lundgren et al. | ..... | 264/245 |
| 3,368,811 | A * | 2/1968 | Finney | ..... | 473/300 |
| 3,508,280 | A * | 4/1970 | Osborn | ..... | 2/159 |
| 3,532,344 | A * | 10/1970 | Masstab | ..... | 473/205 |
| 4,665,565 | A * | 5/1987 | Odom | ..... | 2/161.2 |
| 4,691,387 | A * | 9/1987 | Lopez | ..... | 2/161.3 |
| 5,232,225 | A * | 8/1993 | Snyder | ..... | 473/205 |
| 5,742,942 | A | 4/1998 | Sykes | | |
| 5,984,795 | A * | 11/1999 | Stafford | ..... | 473/206 |
| 6,732,377 | B1 * | 5/2004 | Wilkinson | ..... | 2/161.4 |
| 7,211,004 | B2 * | 5/2007 | DeMarco | ..... | 473/201 |
| 2002/0147054 | A1 * | 10/2002 | Wu et al. | ..... | 473/205 |
| 2003/0045370 | A1 * | 3/2003 | Jaw | ..... | 473/302 |
| 2004/0132538 | A1 * | 7/2004 | Oury et al. | ..... | 473/205 |
| 2004/0142756 | A1 * | 7/2004 | Oury | ..... | 473/205 |
| 2005/0268372 | A1 * | 12/2005 | DeMarco | ..... | 2/160 |

FOREIGN PATENT DOCUMENTS

| | | | |
|---|---|---|---|
| CA | 1232403 | * | 2/1988 |
| GB | 2313320 A | * | 11/1997 |

* cited by examiner

*Primary Examiner*—Raleigh W. Chiu
(74) *Attorney, Agent, or Firm*—Thomas F. Lebens; Sinsheimer Juhnke Lebens & McIvor, LLP

(57) ABSTRACT

A grip system and/or apparatus for golfers with weak hand strength comprising: at least one mating glove and a club grip; the mating glove for use in covering a person's hand and for interfacing and mating with the club grip; the mating glove possessing a palm side, a dorsal side, and finger compartments; the mating glove further comprising loops material for mating with complementary hooks material integrated into the club grip; the club grip having a top side, a bottom side, an upper half and a lower half; the club grip further comprising recesses integrated within the club grip for housing the hooks material.

13 Claims, 10 Drawing Sheets

MATING GOLF GLOVE WITH CLUB GRIP

FIELD OF THE INVENTION

The present invention relates to sporting goods and more particularly pertains to golf equipment.

BACKGROUND OF THE INVENTION

Golf requires a certain amount of gripping force with the club to allow swinging action and impact with a golf ball. Golfers who experience a weakened grip due to complications with arthritis, carpal tunnel syndrome, accretions of hand and wrist injuries, congenital defects, nerve injury and normal aging processes lack the sufficient gripping power needed to ensure golf club stability, control and alignment during swing and impact with the golf ball. For those people who are afflicted with a weakened grip, they may find golf virtually impossible to play. Golfers with weakened hand strength, or golfers who have not been taught a fundamentally sound or technically correct grip configuration, will often have difficulty squaring the clubface at impact with the golf ball which can lead to twisting of the golf club and club face thus producing an inaccurate shot. Inaccurate shots veer from the intended trajectory. Furthermore, as a golfer's hands fatigue during a round of golf, play becomes even more difficult and the club may completely slip out of the hands and become airborne creating a serious hazard to people standing nearby.

The golfing and sporting industries have not adequately addressed the problems encountered by those with weakened hand strength. Furthermore, these industries have not provided effective grip training aids for teaching golfers a technically correct gripping configuration.

Although there are many schools of thought regarding the correct grip of the gripping portion of the golf club shaft, golf instruction schools predominately teach 2 (two) styles of a gripping configuration. In the Vardon grip, the little finger on the trailing hand (the one placed lower on the club—right hand for a right—handed player) is placed between the index and middle finger on the lead hand (the hand that is higher on the club). The lead-hand thumb should fit in the "lifeline" of the trailing hand. The second technique teaches that the grip should be located in the palm of the hands avoiding interlocking between the fingers. This $2^{nd}$ style is referred to as the "Natural Grip."

There have been some other attempts to solve these problems. Some golfers have resorted to the use of pine tar which is obviously not very effective as the pine tar only lasts a short time requiring frequent re-application which can also transfer pine tar to clothing, golf ball and equipment further hindering the player's game. Some grip manufactures have integrated enlarged golf grips, or raised ridges or dots on the grip surface. However, these changes do not sufficiently solve the aforementioned problems.

Unfortunately, the prior art offered in the marketplace has not solved these issues. U.S. Pat. No. 5,742,942 does attempt to enable a person to attain a better grasp of the golf club. However, this product is cumbersome to use. The strap mechanism is difficult and awkward to fasten around a person hand (s). If a golfer is experiencing bilateral weakness thus requiring both hands to be strapped, third party assistance may be required. In addition, this product may be embarrassing for some golfers to use in the company of friends, family or strangers due to its appearance and laborious application.

Therefore, what is clearly needed in the golfing industry is a system and or apparatus that enables golfers and other athletes with a weakened grip to grasp a club with the appropriate force as to stabilize the golf club and avoid club head twisting at impact with the golf ball. Moreover, the invention described herein, comprised of a specially configured golf glove and gripping portion of a golf club shaft, can provide the solution to enable a golfer handicapped by weakened and insufficient hand grip strength to play golf. In addition, the system and or apparatus imparts a feel nearly identical with that of existing golf gloves and the gripping portion of the golf shaft with the special features thereof not readily noticeable to other golfers.

SUMMARY OF THE INVENTION

It is an object of the present invention to provide a system and apparatus designed especially for golfers with weakened hand strength to attain a grip with sufficient strength to control the golf club to limit club twisting such that the clubface will be square upon impact with the ball resulting in a more accurate shot which will give the golfer a sense of confidence. This enhanced grip will enable a golfer to strike a golf ball by squaring a clubface upon impact with the ball. The present invention will provide a feel nearly identical with that of a standard golf glove. Moreover, the system and apparatus will be relatively discrete as its enabling features are not readily visible to others.

It is a further object of the present invention to provide a system and apparatus for teaching golfers a technically correct grip of a golf club. This is achieved by placing various patterns of loops or hooks material on the glove in order to accord with a specific golf grip.

BRIEF DESCRIPTION OF THE DRAWING FIGURES

FIG. 1 is a perspective view of an exemplary system according to an embodiment of the present invention.

FIG. 2*a* is a is a plan view and side view of an exemplary embodiment of the present invention.

FIG. 2*b* is a plan view of a preferred embodiment of the present invention.

FIG. 3*a* is a perspective view of a preferred embodiment of the present invention.

FIG. 3*b* is a perspective view of a preferred embodiment of the present invention.

FIG. 3*c* is a perspective view of a preferred embodiment of the present invention.

DESCRIPTION OF PREFERRED EMBODIMENTS

According to a preferred embodiment of the present invention, a unique system and/or accompanying apparatus is used to enable people with weakened hand strength to sufficiently secure a grip of a golf club. The present invention is also used to teach a golfer the technically correct means of gripping a golf club. The present invention imparts a feel nearly identical with that of a golf glove. The present invention configures a golf glove in such a way that the hand(s) upon which it is to be used can attain a forceful, grasping, and linking relationship with the golf club grip portion of a golf club shaft during the address and swing of a golf club. The present invention is described in enabling detail below.

Figure 1:
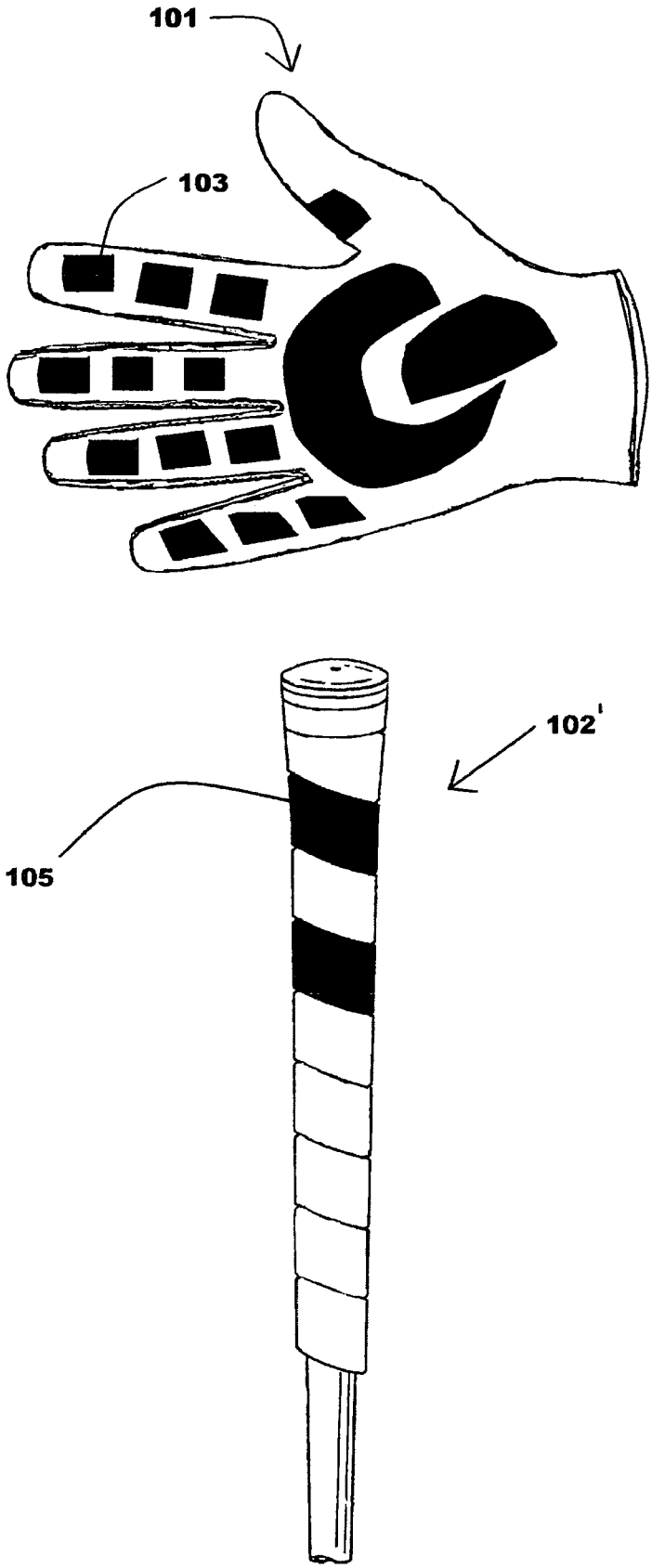

FIG. 1 illustrates a preferred embodiment of the present invention. Grip system 100 includes at least one glove 101 and club grip 102'. Both the glove 101 and the club grip 102 are adapted to mate with each other in order to secure firmly with each other.

Glove 101 in a preferred embodiment is an ordinary golf glove. The glove 101 has a palm side, a dorsal side, and finger compartments. The palm side refers to the planar surface which interfaces with the palm of a golfer. The dorsal side refers to the back surface of the glove 101 which interfaces with the back side of a golfer's hand. And the finger compartments refer to the compartments of the glove 101 which house a golfer's fingers. The type of material(s) used to comprise the golf glove is of no consequence since just about any material might be expedient.

The glove 101 further incorporates loops material or hooks material (commonly known as Velcro®, a registered Trademarked material) upon the palm side of the glove. In some preferred embodiments where the glove incorporates loops material, the loops material will mate with the hooks material which is incorporated into the club grip 102'. In preferred embodiments where the glove 101 incorporates hooks material, the hooks material will mate with the loops material which is incorporated into the club grip 102'.

Figure 2A:
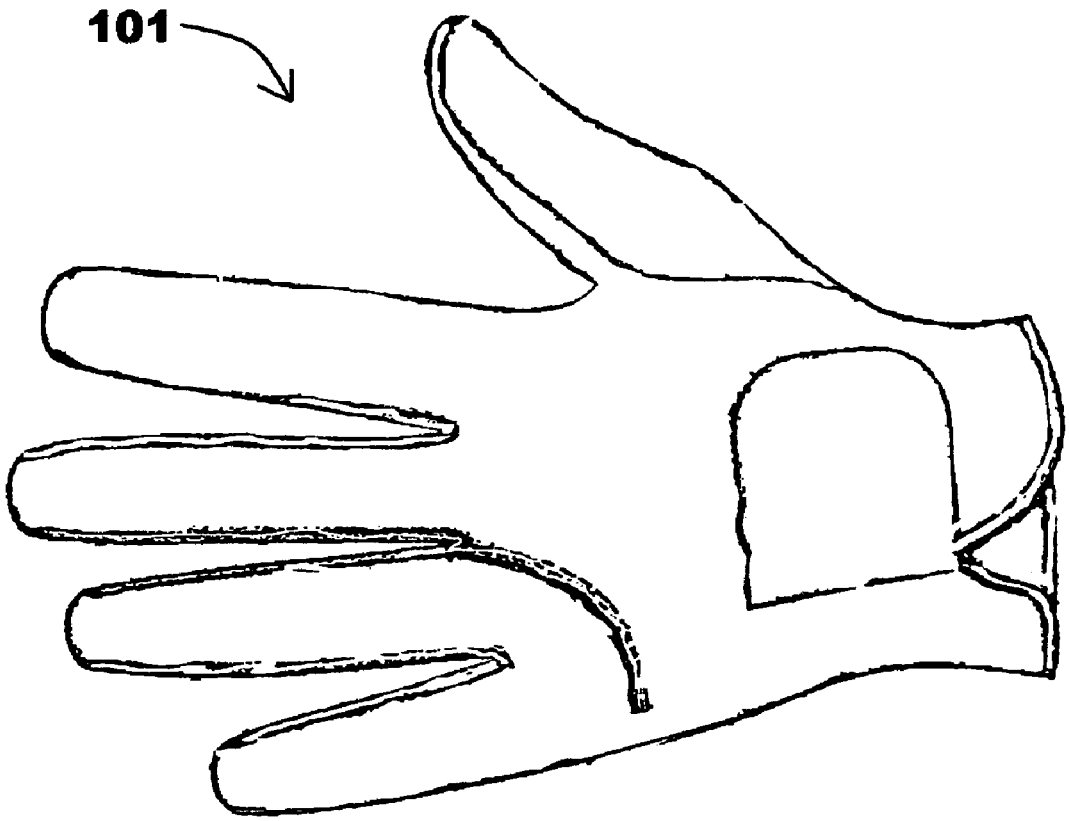
Figure 2A:
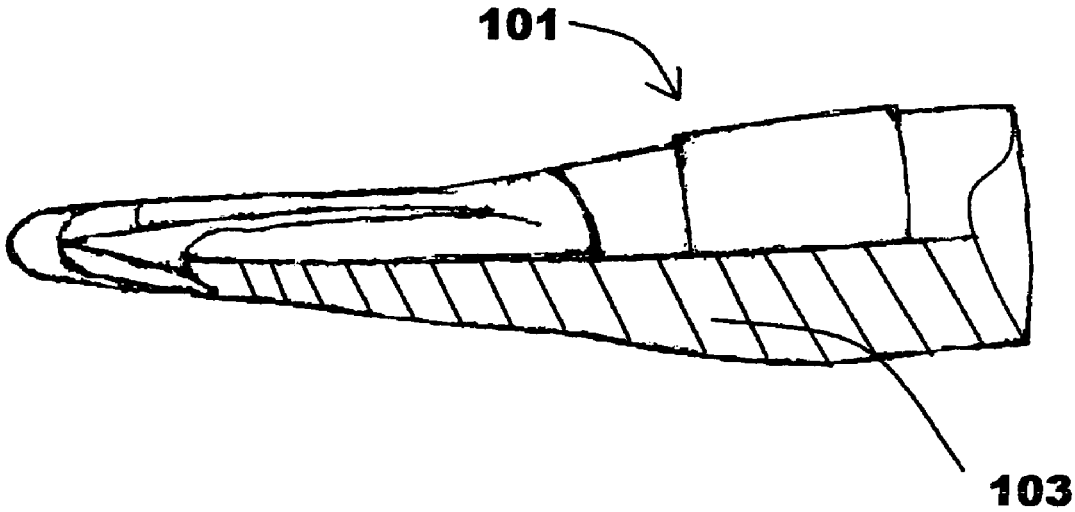
Figure 2B:
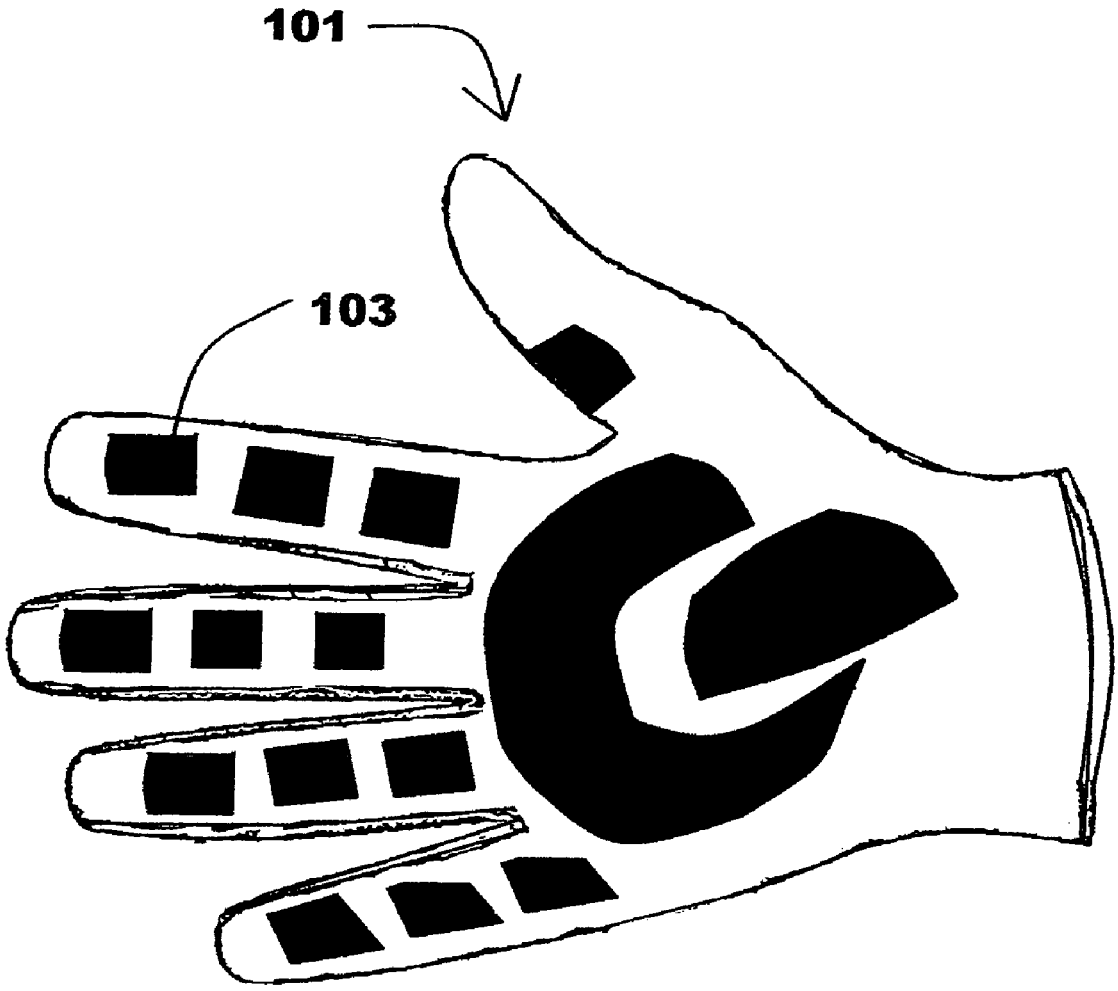

FIGS. 2*a-b* further illustrate the glove 101. Glove 101 incorporates the loops material 103 by sewing the loops material into the glove. Since the interfacing contact is between the palm side of the glove with the grip, the only side which will be incorporating the loops material or the hooks material is the palm side. Since the means and methods of sewing or otherwise affixing (eg. adhesive means such as glue or adhesive strips) the loops material or the hooks material with the glove is readily apparent to one skilled in the art, no further detail shall be further discussed other than to mention briefly that adhesive patches of loops material or the hooks material may also be used to retrofit the gloves.

Figure 6:
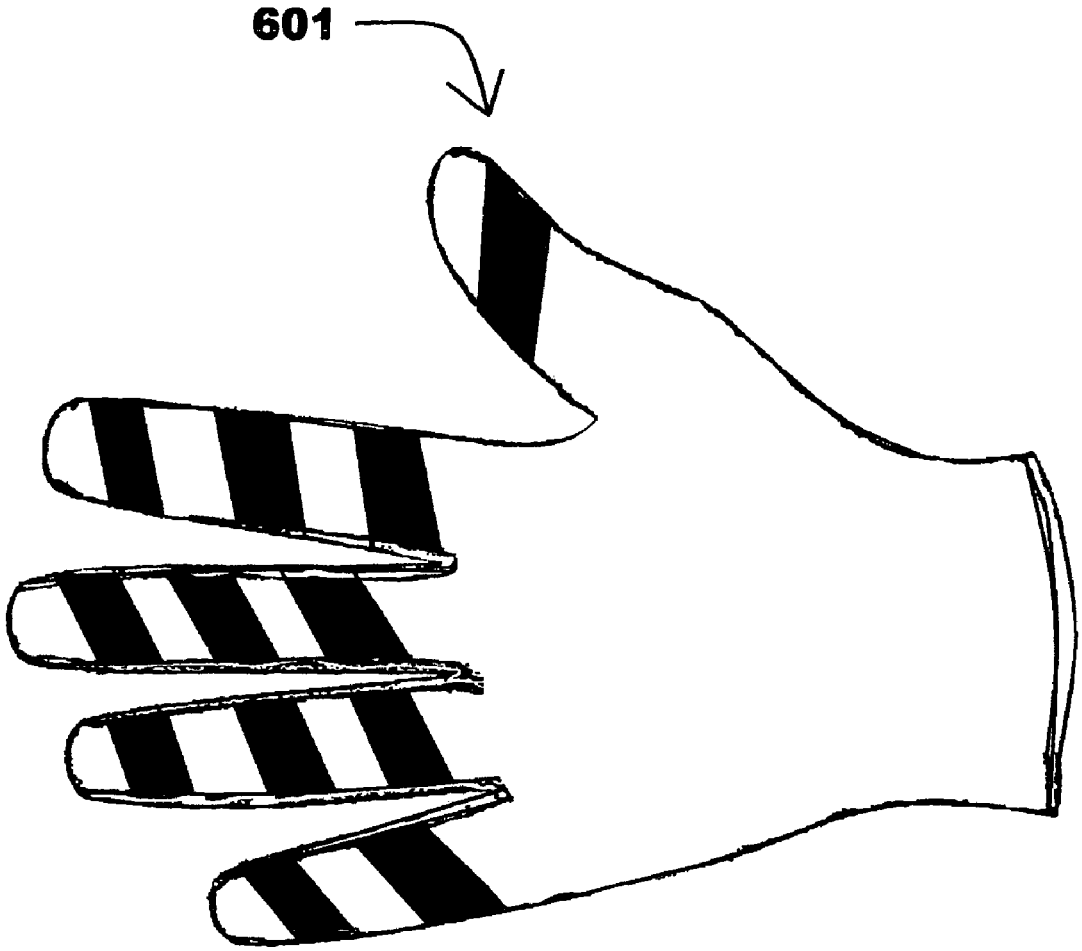
FIG. 6 is a perspective view of a preferred embodiment of the present invention.
Figure 7:
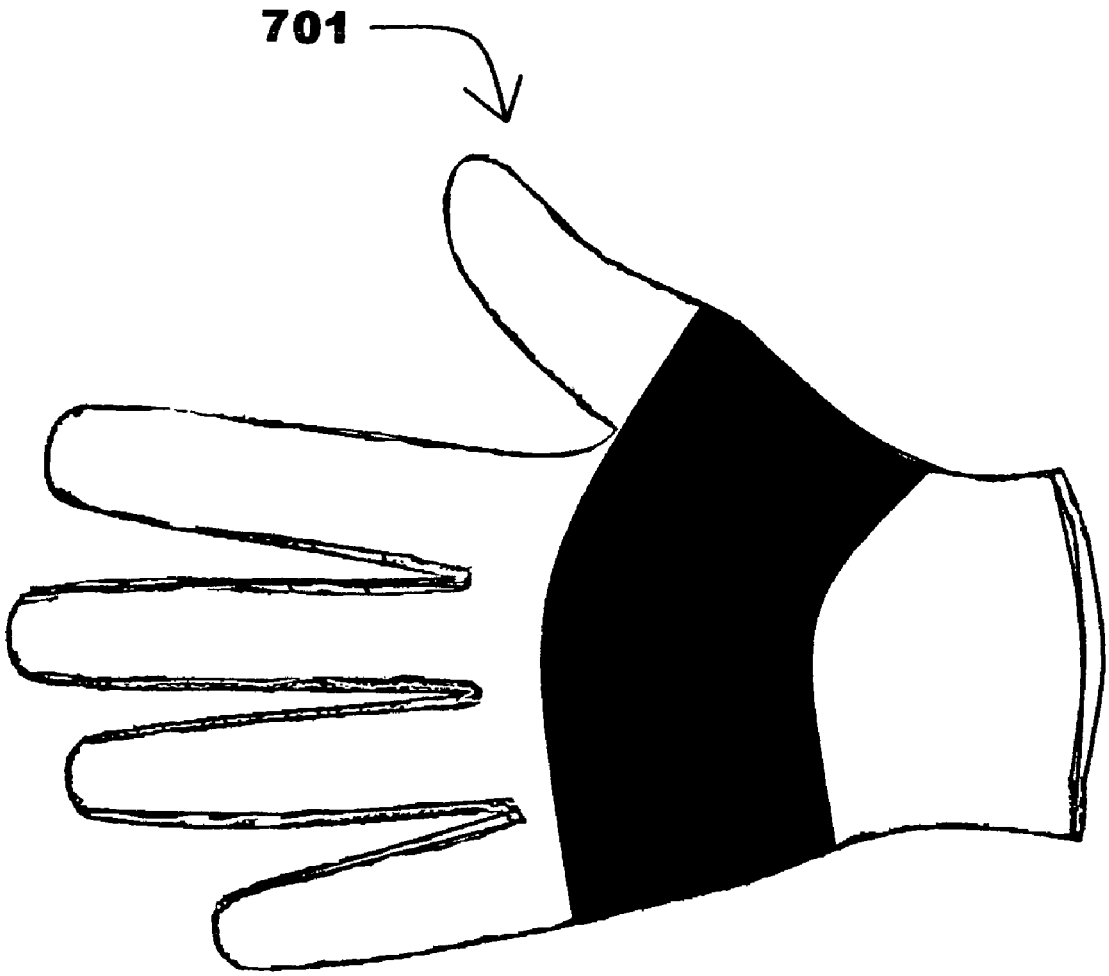
FIG. 7 is a perspective view of a preferred embodiment of the present invention.

Since many golf instructors differ widely as to the proper methods of gripping a golf club, various patterns of loops material or hooks material may be used in order to accord with these different types of grips. Perhaps the most popular type of grip is the "Vardon" style grip. The Vardon style grip places the club grip in the fingers of a person rather than the palm. When using a Vardon grip, a person may use the glove 601 embodiment illustrated in FIG. 6. Alternatively, if a golfer prefers a "Natural" grip, he or she may place the club grip into the palms with a 10-finger grip. This glove 701 embodiment is illustrated in FIG. 7. Other types of golf grips whether they use interlocking fingers, etc. may be taught using accommodating patterns of loops material or the hooks material incorporated into the glove 101. For this reason, there may be a panoply of different embodiments of the glove 101.

Figure 3A:
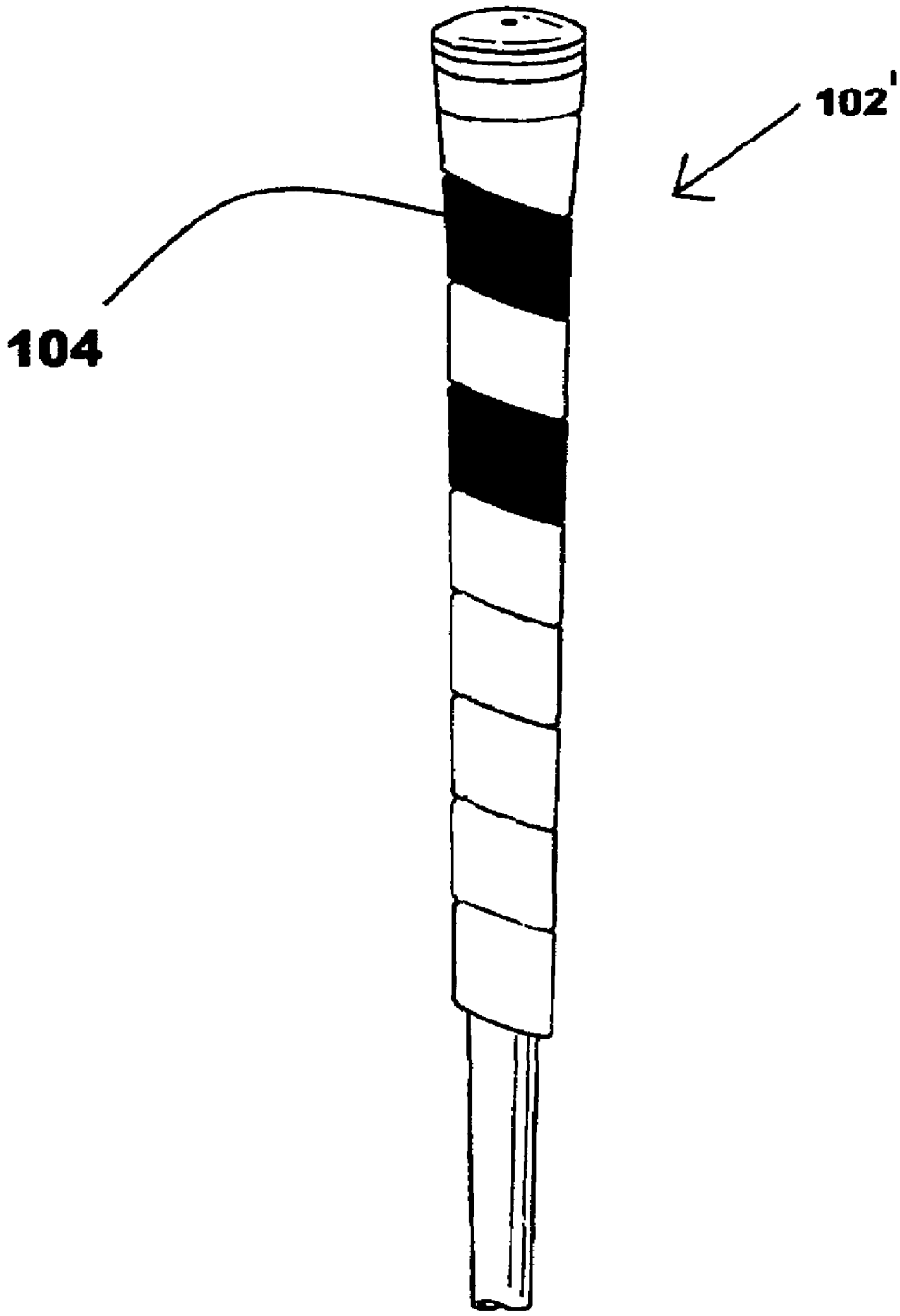
Figure 3B:
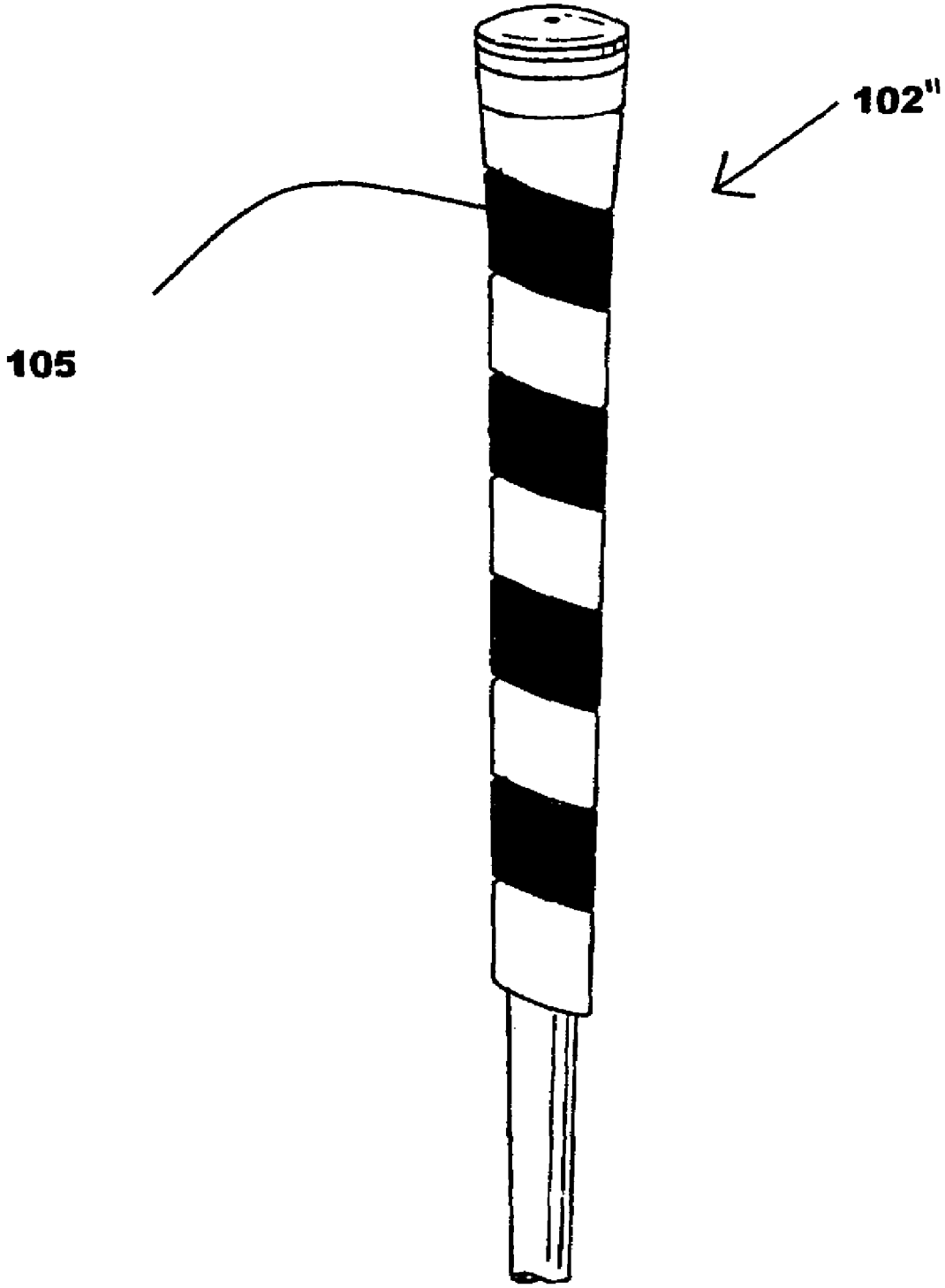
Figure 3C:
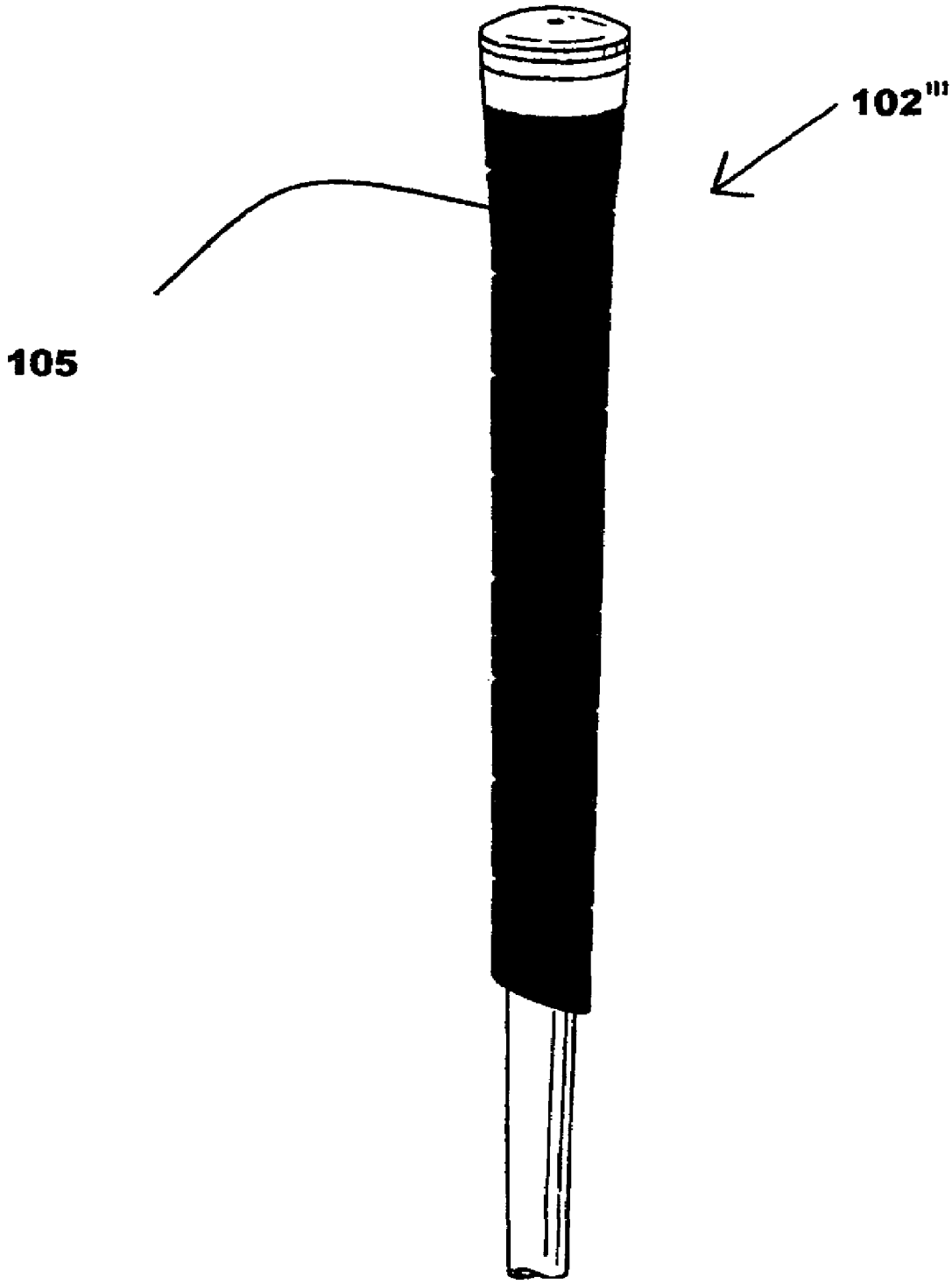

FIG. 3*a-c* illustrate different preferred embodiments of the club grip 102', 102", and 102'". Golf club grips abound in many different styles and are composed of a panoply of materials. Materials such as polymer (eg. Ethylene Propylene Diene Monomer), leather (eg. cowhide or calfskin and all mammal, amphibious, reptile and any other skin materials), rubber (natural or synthetic), cotton, various types of cord (such as classic, GX, or tour wrap) or granulated cork are all adaptable for use with the present invention. For this reason, the materials used to compose the club grip 102', 102", 102'" are of no consequence to the present invention. Moreover, other characteristics or components of a grip which may be integrated such as small holes, grooves or ridges may also be incorporated with the present invention. However, small holes, grooves or ridges are strictly optional for use with the present invention.

Club grips 102 in some preferred embodiments are specially engineered, die-cast molded rubber golf club grips integrating hooks material 104 (or loops material in some preferred embodiments) around the club grip 102. In the illustrated preferred embodiment, recesses are used to make the hooks or loops material flush with the circumference of the club grip 102', 102", 102'". The purpose of the recesses is to obscure the view of the hooks or loops material on the club grip 102. The primary reason for obscuring the view of the hooks or loops material is to alleviate any insecurity or conflicting emotions of a golfer when playing or practicing with other golfers. Another reason is that the recesses may be more comfortable to the touch for some golfers. It must be pointed out here that the use of recesses is not specifically required by the present invention. In other words, some embodiments may incorporate the recesses and others may not.

Turning now to FIGS. 3*a-c* in the first embodiment, only the top portion of the club grip 102 incorporates the hooks material 104. Since most golfers only use one glove for the hand on the upper portion of the club grip the embodiment illustrated in FIG. 3*a* will probably be the embodiment most often used.

Figure 5:
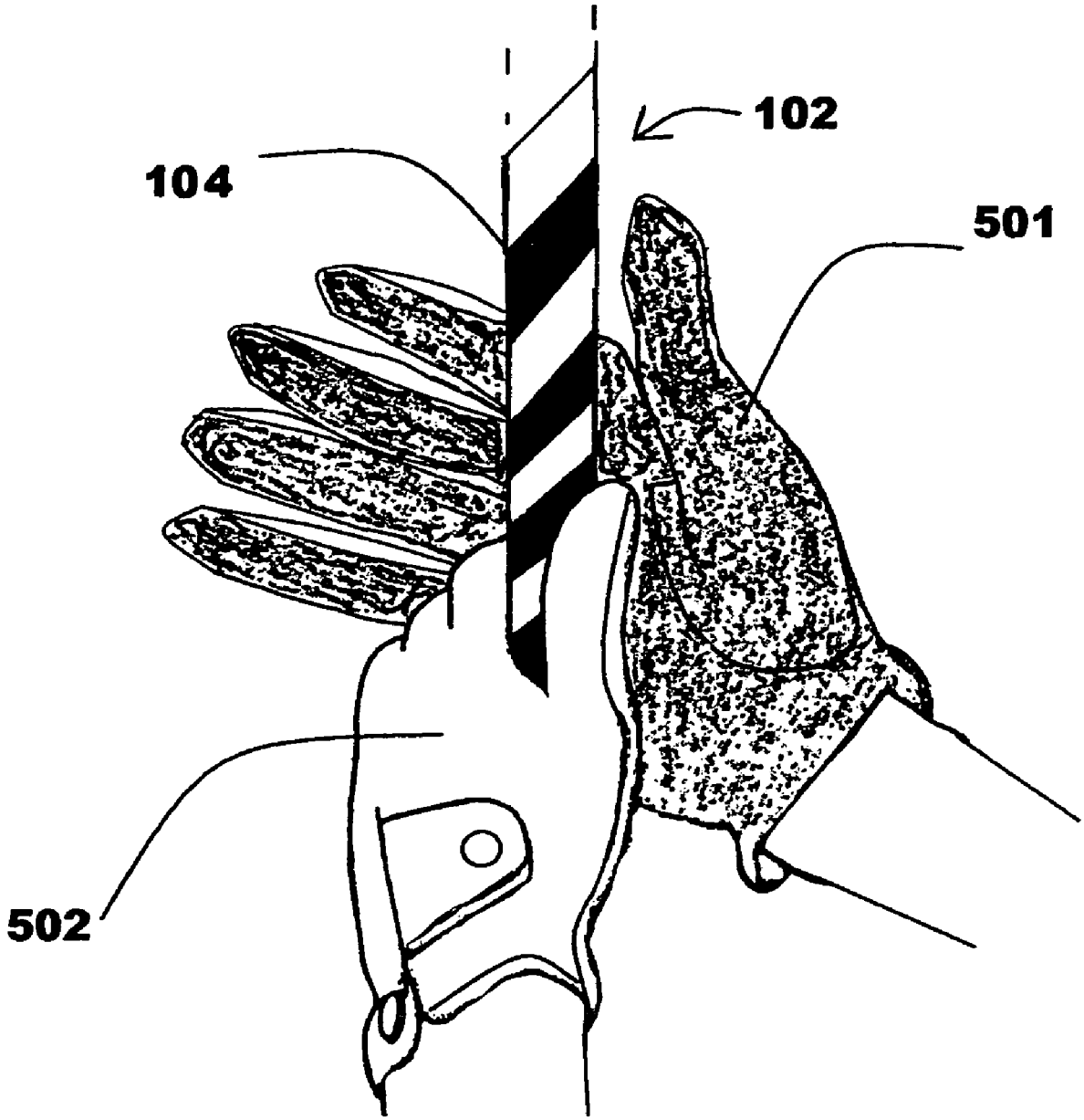
FIG. 5 is a perspective view of a preferred embodiment of the present invention.

FIG. 3*b* and FIG. 5 illustrate an alternative preferred embodiment of the club grip 102" of the present invention. In this bilateral embodiment two gloves 501, 502 are used. Although this is unorthodox for most golfers it may help those golfers with weakened hand strength. Since this bilateral embodiment is meant to be used with gloves 501, 502 on both hands, the club grip 102" integrates hooks material 104 (and loops material in some preferred embodiments) in alternate spiraling rows down the entire length of the club grip 102"

FIG. 3*c* illustrates another preferred bilateral embodiment of the club grip 102'". In this bilateral embodiment both gloves 501, 502 are used. Unlike club grip 102", club grip 102'" integrates hooks material 104 throughout the entire surface area of the club grip 102'".

Figure 4:
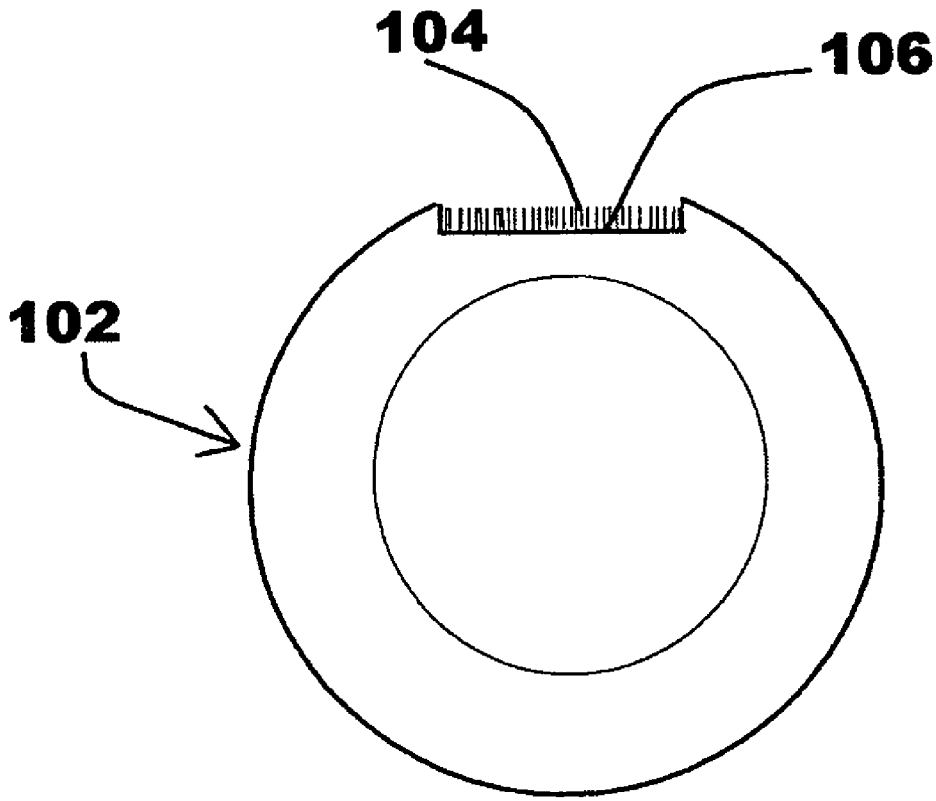
FIG. 4 is a cross-sectional view of a preferred embodiment of the present invention.

FIG. 4 illustrates a cross sectional view of a club grip 102. In preferred embodiments where the club grip 102 is recessed, the club grip 102 is recessed in such a way such that the hooks material (or loops material in some preferred embodiments) is flush with the grip surface. The hooks or loops material are embedded within the recess 106. This method of integrating the hooks material (or loops material in some preferred embodiments) is preferable because it is less noticeable to the naked eye. This recessed design is also more comfortable to the touch.

It will be apparent to the skilled artisan that there are numerous changes that may be made in embodiments described herein without departing from the spirit and scope of the invention. Further, features of the embodiments shown in the various figures may be employed with the embodiments of the other figures. Therefore, the scope of the invention is to be determined by the terminology of the following claims and the legal equivalents thereof. As such, the invention taught herein by specific examples is limited only by the scope of the claims that follow.

What is claimed is:

1. A grip system comprising:

at least one mating glove; and a grip, the at least one mating glove for accommodating at least one user's hand and for interfacing and mating with the grip, the at least one mating glove comprising a palm side, a dorsal side, and a plurality of finger compartments, the mating glove further comprising a hook and loop fastener material, the grip comprising a top side, a bottom side, an upper half, a lower half, and at least one recess, the grip further comprising a complementary hook and loop fastener material flushly disposed in the at least one recess, and the at least one mating glove hook and loop fastener material being attachable and detachable in relation to the grip complementary hook and loop fastener material in a discreet visually obscured manner.

2. The grip system of claim 1, wherein the at least one recess comprises a spiraling configuration, and wherein the complementary hook and loop fastener material is flushly disposed in the at least one recess in the spiraling configuration.

3. The grip system of claim 1, wherein the hook and loop fastener material is integrated into at least one element selected from a group consisting essentially of the plurality of finger compartments and the palm side.

4. The grip system of claim 1, wherein the grip comprises rubber.

5. The grip system of claim 1, wherein the complementary hook and loop fastener material extends through at least one location selected from a group consisting essentially of the grip upper half and the grip lower half.

6. The grip system of claim 1, wherein the at least one recess comprises a spiraling configuration, wherein the complementary hook and loop fastener material is flushly disposed in the at least one recess in the spiraling configuration, wherein the hook and loop fastener material is integrated into at least one element selected from a group consisting essentially of the plurality of finger compartments and the palm side, and wherein the complementary hook and loop fastener material extends through at least one location selected from a group consisting essentially of the grip upper half and the grip lower half.

7. An instructional grip system comprising:

at least one mating glove; and a club grip, the at least one mating glove for accommodating at least one user's hand and for interfacing and mating with the club grip, the at least one mating glove comprising a palm side, a dorsal side, and a plurality of finger compartments, the mating glove further comprising a hook and loop fastener material, the club grip comprising a top side, a bottom side, an upper half, a lower half, and at least one recess, the club grip further comprising a complementary hook and loop fastener material flushly disposed in the at least one recess, and the at least one mating glove hook and loop fastener material being attachable and detachable in relation to the club grip complementary hook and loop fastener material in a discreet visually obscured manner under instructional conditions.

8. The instructional system of claim 7, wherein the hook and loop fastener material is integrated into the plurality of finger compartments for facilitating training at least one grip selected from a group consisting essentially of a Vardon style nine-finger grip and a Vardon-style ten-finger grip.

9. The instructional system of claim 7, wherein the hook and loop fastener material is integrated into the palm side for facilitating training at least one grip selected from a group consisting essentially of a natural-style nine-finger grip and a natural-style ten-finger grip.

10. The instructional system of claim 7, wherein the complementary hook and loop fastener material extends though at least one location selected from a group consisting essentially of the grip upper half and the grip lower half.

11. The instructional system of claim 7, wherein the at least one recess comprises a spiraling configuration, and wherein the complementary hook and loop fastener material is flushly disposed in the at least one recess in the spiraling configuration.

12. The instructional system of claim 7, wherein the hook and loop fastener material is integrated into the plurality of finger compartments for facilitating training at least one club grip selected from a group consisting essentially of a Vardon-style nine-finger grip and a Vardon-style ten-finger grip, wherein the hook and loop fastener material is integrated into the palm side for facilitating training at least one club grip selected from a group consisting essentially of a natural-style nine-finger grip and a natural-style ten-finger grip, wherein the complementary hook and loop fastener material extends through at least one location selected from a group consisting essentially of the club grip upper half and the club grip lower half, wherein the at least one recess comprises a spiraling configuration, and wherein the complementary hook and loop fastener material is flushly disposed in the at least one recess in the spiraling configuration.

13. A grip system for training a user having weak hand strength comprising:

at least one mating glove; and a grip, the at least one mating glove for accommodating at least one user's hand and for interfacing and mating with the grip, the at least one mating glove comprising a palm side, a dorsal side, and a plurality of finger compartments, the mating glove further comprising a hook and loop fastener material, the grip comprising a top side, a bottom side, an upper half, a lower half, and at least one recess, the grip further comprising a complementary hook and loop fastener material flushly disposed in the at least one recess, and the at least one mating glove hook and loop fastener material being attachable and detachable in relation to the grip complementary hook and loop fastener material in a discreet visually obscured manner under training conditions.

* * * * *